US007525509B1

(12) United States Patent
Robinson

(10) Patent No.: US 7,525,509 B1
(45) Date of Patent: Apr. 28, 2009

(54) TUNABLE ANTENNA APPARATUS

(75) Inventor: Kevin L. Robinson, Clay, NY (US)

(73) Assignee: Lockheed Martin, Syracuse, NY (US)

( * ) Notice: Subject to any disclaimer, the term of this patent is extended or adjusted under 35 U.S.C. 154(b) by 0 days.

(21) Appl. No.: 11/500,868

(22) Filed: Aug. 8, 2006

(51) Int. Cl.
*H01Q 1/36* (2006.01)

(52) U.S. Cl. ..... 343/895; 343/787

(58) Field of Classification Search ..... 343/895, 343/787

See application file for complete search history.

(56) References Cited

U.S. PATENT DOCUMENTS

| | | | | |
|---|---|---|---|---|
| 5,469,165 | A | 11/1995 | Milroy | |
| 5,528,769 | A | 6/1996 | Berenz et al. | |
| 5,861,845 | A | 1/1999 | Lee et al. | |
| 6,313,804 | B1 * | 11/2001 | Falk | 343/757 |
| 6,335,710 | B1 * | 1/2002 | Falk et al. | 343/895 |
| 6,683,517 | B2 * | 1/2004 | Chiu et al. | 333/243 |
| 6,864,843 | B2 * | 3/2005 | du Toit et al. | 343/700 MS |
| 2003/0132892 | A1 * | 7/2003 | Yde-Andersen et al. | 343/895 |

FOREIGN PATENT DOCUMENTS

WO 03/079043 A2 9/2003

OTHER PUBLICATIONS

Garafalo, David A. Characterization of an optically controlled phased array antenna, Proceedings of SPIE—The International Society for Optical Engineering v 3075, (1997). 3075: 84-88. Society of Photo-Optical Instrumentation Engineers, Bellingham, WA, USA.

Varadan, V.K. et al. Design and development of conformal smart spiral antenna; In: Smart structures and materials 1996—Smart electronics and MEMS; Proceedings of the Conference, San Diego, CA, (Feb. 28, 29, 1996 ), SPIE Proceedings. vol. 2722: 46-54. Society of Photo-Optical Instrumentation Engineers Bellingham, WA, USA.

Brookner, E. Phased arrays for the new millennium. 2001 CIE International Conference on Radar Proceedings (2001)1194: 34-41.

Rago, C et al. Target tracking in the presence of ECM: a filter design tool. Proceedings of the Twenty-Ninth Southeastern Symposium on System Theory (1997) 514-518.

Holmgren, T. et al. Ultra wideband reconfigurable beamforming and beam shaping for radar and electronic warfare applications; Digest 10th International Symposium on Microwave and Optical Technology (2005) 186-189.

(Continued)

*Primary Examiner*—Tan Ho
(74) *Attorney, Agent, or Firm*—Howard IP Law Group, PC

(57) ABSTRACT

The electrical length of an antenna element is modified by depositing on a top surface of a voltage variable dielectric a first conductor pattern. The identical conductor pattern is also deposited on a bottom surface of the dielectric layer. The dielectric layer is tunable and the structure is a sandwich with two identical conductors on top and bottom of a tunable dielectric area. The sandwich is created in the same shape as a planar spiral or logarithmic spiral and a DC electric field is applied between the conductors that control the dielectric constant and hence the electrical length of the antenna element.

15 Claims, 2 Drawing Sheets

OTHER PUBLICATIONS

Pattan, B. The versatile Butler matrix; Microwave Journal, Euro-Global Edition. (Nov. 2004) 47:11:126-138.

Hill, P.C.J. et al. Antenna beamforming for EW using adaptive layered networks. IEE Colloquium (Digest) Jan. 31, 1994) n 025:2/1-2/3. IEE, Stevenage, England.

Singh, Lakhmir. Some ECM aspects for phased array systems; IEEE International Symposium on Phased Array Systems and Technology (2000) 513-516. IEEE, Piscataway, NJ, USA.

Hatke, G. F. et al. Multipath effects on F-15 and F-16 multi-channel GPS antenna performance. Conference Record of the Thirty-Third Asilomar Conference of Signals, Systems, and Computers (1999) 2:922-926.

Alfredson, M et al. Design considerations for an image rejection mixer in a broadband digital beamforming antenna array system; 2000 Asia-Pacific Microwave Conference. Proceedings (2000) 245-248.

Gouin, J. P. et al. HF 125 W half-loop antennas in ALE and ECCM for land mobile, navy and helicopter use; Eighth International Conference on HF Radio Systems and Techniques (IEE Conf. Publ.No. 474) (2000) 49-52.

Gesell, L. H. et al. True time-delay beamforming using Bragg grating resonators. Proceedings of the SPIE—The International Society for Optical Engineering; (1996). 2844:223-233.

Riza, Nabeel A. Fault-Tolerant Multi-Beam Photonic Beamforming for Wideband Array Antennas; Proc SPIE Int Soc Opt Eng; (2003) 5260: 62-73.

Nelander, A. Deconvolution approach to terrain scattered interference mitigation, Proceedings of the 2002 IEEE Radar Conference (2002) 344-349.

McDonald, K. F. et al. Lessons learned through the implementation of Space-Time Adaptive Processing algorithms for GPS reception in jammed environments. PLANS 2004. Postion Loctation and Navigation Symposium (2004) 418-428.

Brookner, E. Phased arrays around the world—progress and future trends; IEEE International Symposium on Phased Array Systems and Technology 2003 1-8.

Brookner, E. Phased arrays: major advances and future trends into the next millennium; Proceedings of the 28th Moscow International Conference on Antenna Theory and Technology; (1998) 24-42.

Jenn D.C. et al. Digital antenna architectures using commercial off-the-shelf hardware; IEEE Antennas Propag Soc AP S Int Symp; (2004) 3:3241-3244.

Hansen, H. J. et al. Microstrip Broadband Phased array elements. Smart Structures, Devices and Systems II, (2005) 5849: Part 1: 16-22.

Mileusnic, M. Design and Implementation of Fast Antenna Tuners for HF Radio Systems. International Conference on Information , Communications and Signal Processing, Singapore, Sep. 9-12, 1997, 1722-1725.

Diaz, Rodolfo. The Realization of a Lossy Material with a Prescribed Transparency Window in the Bulk. Final Progress Report (2000) 1-20.

Golino, G. A genetic algorithm for optimizing the segmentation in subarrays of planar array antenna radars with adaptive digital beamforming; IEEE International Symposium on Phased Array Systems and Technology 2003 211-216.

* cited by examiner

TUNABLE ANTENNA APPARATUS

FIELD OF THE INVENTION

The present invention relates generally to antenna systems, and more particularly to a tunable antenna element.

BACKGROUND OF THE INVENTION

Radar and electronic warfare (EW) systems require antenna elements to interface the system with the atmosphere. The antenna elements should present as low a VSWR (voltage standing wave ratio) as possible to the driving electronics for efficient transfer of power between the system and the atmosphere. The ability to tune an antenna element for the correct impedance at a given frequency greatly enhances the efficiency and bandwidth of the system. Tuning may be accomplished either manually or automatically, which represents a significant enhancement to typical radar or EW systems.

As one can ascertain, many different radar antennas exist, which vary both in size and function. However, the basic function of a radar antenna is to direct through the atmosphere the radiated power and receiver sensitivity to the azimuth and elevation coordinates of a target. It is generally desirable in radar systems to substantially reduce the VSWR and to provide an efficient way of tuning a radar element so that one can correct the impedance of the radar at given frequencies. This can significantly enhance the efficiency and bandwidth of the operational system. Existing solutions use a fixed dielectric constant material and trade off bandwidth for VSWR. Alternative mechanisms for providing a reconfigurable antenna are desired.

SUMMARY OF THE INVENTION

The present invention employs a given antenna configuration which is formed on a top side of a dielectric layer. The bottom side of the dielectric layer has formed thereon a congruent antenna configuration which matches the top configuration. The dielectric layer operates as a support. The dielectric is a tunable dielectric layer used for both support and for the cavity. In this manner the antenna element impedance may be tuned for optimum performance at any given frequency by applying various voltages to the dielectric layer.

DETAILED DESCRIPTION OF THE FIGURES

Figure 1:
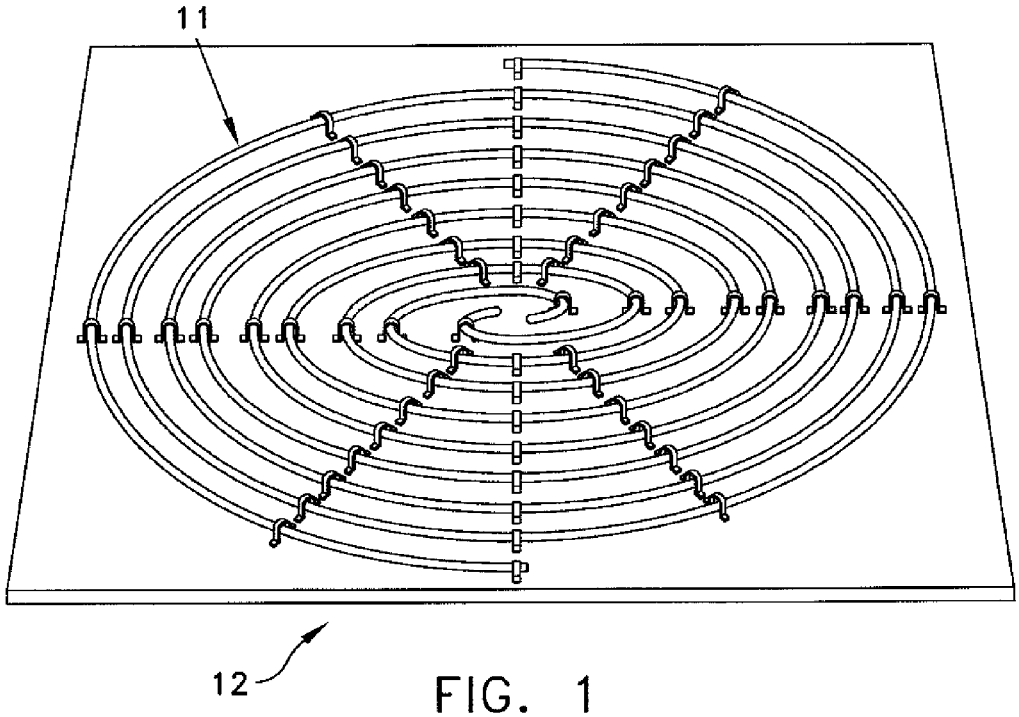
FIG. 1 is a perspective view of a planer spiral antenna element with a ground plate.

FIG. 1 illustrates a planar spiral antenna configuration 10 which employs spiral dipole elements designated by reference numeral 11. The spiral can be a planer spiral or a logarithmic spiral. Such antenna configurations include a ground plane 12 upon which the spiral dipole elements are mounted.

These antennas suffer in regard to low frequency performance as the low frequency performance is limited by the length of the antenna. Logarithmic spiral antenna elements are commonly used for EW applications which require wide bandwidth. The spiral elements typically have greater than an octave of bandwidth and have a very compact shape as depicted in FIG. 1. In any event, as indicated, low frequency performance is limited by the electrical length of the spiral and the cavity depth of one-quarter wave-length or greater at the lowest frequency. The cavity behind the antenna element is usually loaded with a graded absorber to reduce back lobe energy. The absorber tends to be relatively weak near the element and more heavily loaded near the cavity wall.

Figure 2:
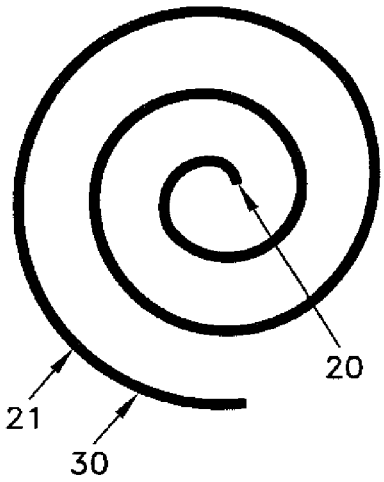
FIG. 2 is a top view of a planar spiral or logarithmic spiral antenna configuration according to an exemplary embodiment of the present invention.

Referring now to FIG. 2, there is shown a spiral conductor pattern which is employed as an antenna element according to an embodiment of the present invention. As shown in the embodiment of FIG. 2, a top side conductor 21 is arranged in a spiral pattern, which may be a logarithmic or a planar spiral. In a preferred embodiment, the conductor is formed of a metal conductor material. The conductor pattern is formed on the top side of a variable dielectric wafer or layer 30. The central portion designated by reference numeral 20 operates as a feed point for the single spiral. The spiral shown in the top view of FIG. 2 represents a top spiral conductor. An identical congruent bottom spiral (not viewable in the plan view of FIG. 2) is disposed beneath the top spiral 21. As will be explained in conjunction with FIG. 3, the top and bottom spirals are mounted on top and bottom surfaces, respectively, of dielectric layer 30.

Figure 3:
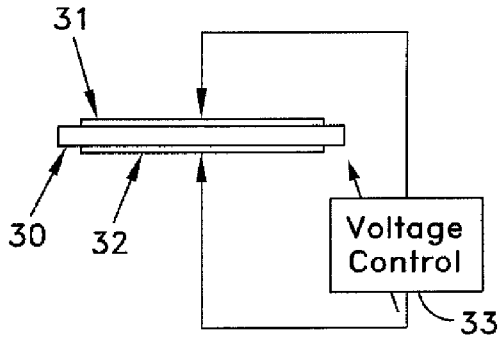
FIG. 3 is a schematic representation of an antenna element and associated control circuitry according to an exemplary embodiment of the present invention.

Referring to FIG. 3 there is shown the central wafer or layer 30 which consists of a voltage variable dielectric. Voltage variable dielectric materials are known. For example, a typical voltage variable dielectric which is well suited for use in conjunction with the present invention is a combination of (Ba, Sr,), Ti, $O_3$. Barium Titanate ($BaTiO_3$) is a crystalline ceramic with good dielectric piezoelectric properties. Barium Titanate is used in capacitors and is useful in forming piezoelectric transducers. It has a high curing point which is higher than that of rochelle salt. Wafer 30 may also be formed of Strontium Titanate, for example. Strontium (Sr) is a metallic element. It is normally found in Celestine and in Strontinite. The Strontinite as indicted is a crystalline and occurs in natural springs and have chemical qualities similar to calcium. Both the Barium and the Strontium have the ability to change capacitance and hence reactance according to applied voltage.

As shown in FIG. 3, wafer 30 can be a wafer of Barium Titanate which has deposited on the top surface a spiral conductor 31 of the exact configuration shown in FIG. 2 and which has a congruent spiral conductor 32 (congruent with spiral conductor 31) deposited on the bottom surface. Each of the spiral conductors has a central feed point designated as 20. A voltage is applied between points 20 of the top conductor and the bottom conductor. The impedance of the wafer 30 varies according to the applied voltage. Essentially, the wafer acts as a capacitor and the capacitance changes in regard to the applied voltage. The changing capacitance serves to tune the antenna elements 31 and 32 so that one can now provide antenna elements with different impedances according to a desired system operation. Accordingly, an aspect of the present invention provides for the ability to reconfigure antennas in a manner so as to control the VSWR to the driving electronics for efficient power transfer between the system and its external interfaces by tuning an antenna element for the correct impedance at a given frequency.

As one can see from FIG. 3, according to an aspect of the present invention, the effective electrical length of the antenna element may be controlled by making a thin sandwich of two identical conductors as 31 and 32 with a tunable dielectric between the conductors. This sandwich is created in the same shape as a planar spiral, or logarithmic spiral, and a DC electric field is applied between the conductors to control the dielectric constant and therefore the electrical length of the element.

Figure 4:
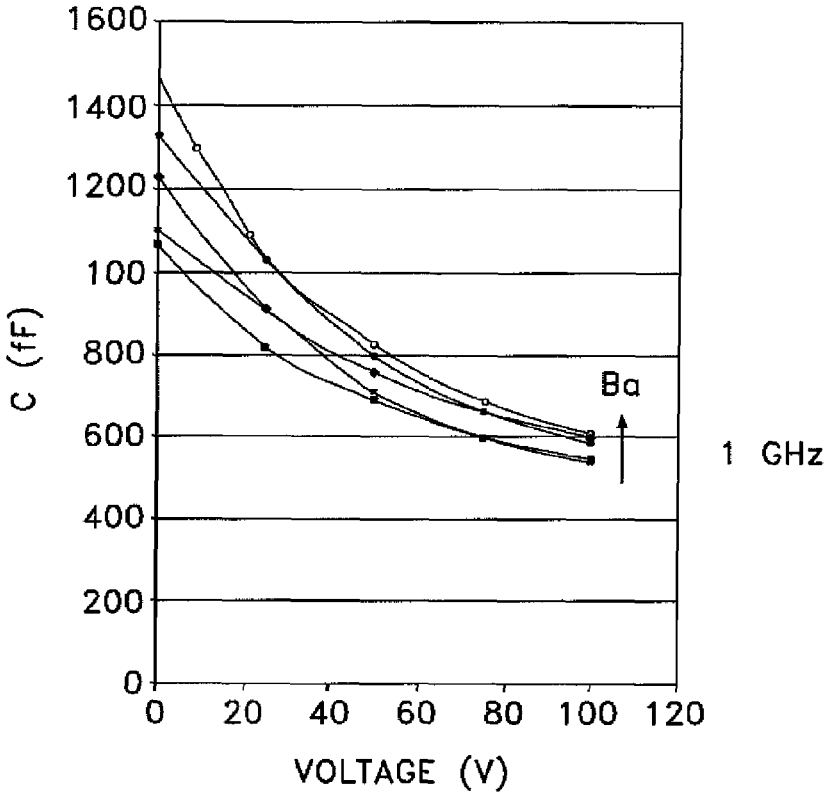
FIG. 4 is a top plan view of an antenna element fabricated according to an aspect of the present invention.

Referring to FIG. 4 there is shown voltage versus capacitance for the Barium Titanate dielectric. The graph of FIG. 4 was performed at one gigahertz (1 GHz). As one can see, there is substantial variation in capacitance for the application of zero to one hundred volts as the capacitance varies between about 1400 femto farads (fF) to 600 fF. The various lines shown and depicted in FIG. 4 are indicative of various operating frequencies. The use of Strontium exhibits similar changes in capacitance. The measurements obtained in FIG. 4 were developed by a test device which basically measured capacitance between one to forty Gigahertz at zero to two hundred volts and greater. The variations shown in FIG. 4 were taken between zero and one hundred. To ascertain capacitance variation 0.8 millimeter BST films were deposited on 0.010 alumina substrates. Gold (Au) topped electrodes were padded with 5 micrometer (um) gaps. These coplanar wave guides operated to test the dielectric constants of both the barium titanate and strontium titanate dielectrics which showed actual capacitance variation as the voltage changed.

Figure 5:
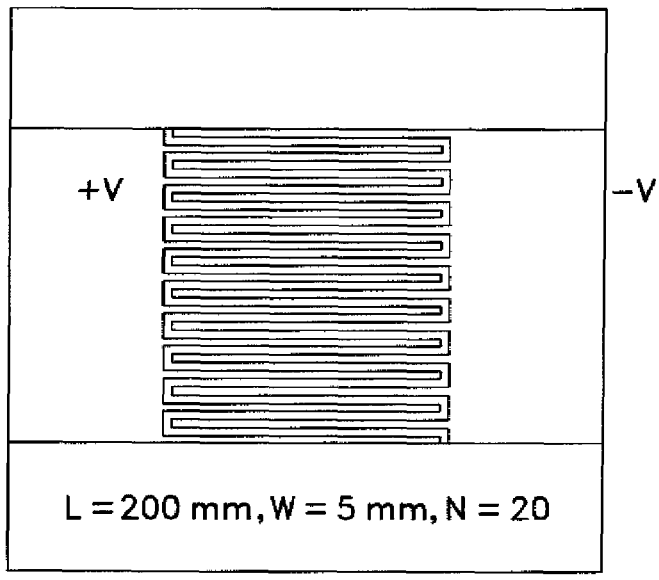
FIG. 5 is a top plan view of an antenna pattern according to an exemplary embodiment of the present invention.

FIG. 5 shows an exemplary capacitance pattern used in verifying operation. These spiral configurations are depicted in FIG. 5 as a top view. The spiral configuration or serpentine configuration in FIG. 5 can be deposited on the top surface of a dielectric while the bottom surface of the dielectric has the same configuration deposited thereon. The voltage from a voltage source such as voltage source 33 of FIG. 3 is applied to the feed point of each spiral. This voltage varies the capacitance according to the applied voltage as depicted in FIG. 4. The variation of capacitance is a variation of impedance and therefore each antenna element can be tuned to match the corresponding circuitry or output and therefore the structure allows increased bandwidth and a much better voltage standing wave ratio at given frequencies. The double benefit applies increased performance with increased bandwidth and lower VSWR. In this manner, lower frequency performance of the antenna element is enhanced with a much smaller footprint. It would be understood by one skilled in the art that various modifications of the present invention may be made. For example, other spiral or antenna configurations can be implemented and deposited on top and bottom surfaces of a dielectric wafer which dielectric constant will vary with a voltage. Also techniques in measuring VSWR are known, and one can now measure VSWR and utilize voltage control in a feedback circuit, whereby if the VSWR increases one will vary the voltage to change the capacitance and attempt to reduce the VSWR. This can be done by an ordinary feedback circuit. Such techniques for providing feedback based on the magnitude or strength of a VSWR should be apparent to those skilled in the art. While the foregoing invention has been described with reference to the above-described embodiments, various modifications and changes can be made without departing from the spirit of the invention. Accordingly, all such modifications and changes are considered to be within the scope of the appended claims.

What is claimed is:

1. A tunable antenna element, comprising:

a wafer of a voltage tunable dielectric, said wafer having a top surface and a bottom surface, a first antenna element pattern located on said top surface of said wafer, a second identical congruent antenna element pattern located on said bottom surface of said wafer, wherein the effective electrical length of said first antenna element pattern and said second antenna element pattern vary according to the voltage applied to said voltage tunable dielectric.

2. The antenna element according to claim 1, wherein said first antenna element pattern is a planar spiral pattern.

3. The antenna element according to claim 1, wherein said first antenna element pattern is logarithmic spiral pattern.

4. The antenna element according to claim 1, wherein said wafer of a voltage tunable dielectric is a wafer of barium titanate ($BaTiO_3$).

5. The antenna element according to claim 1, wherein said wafer of a voltage tunable dielectric is Strontium titanate ($SrTiO_3$).

6. The antenna element according to claim 1, wherein said wafer of a voltage tunable dielectric is a film of dielectric material.

7. A tunable antenna element comprising:

a sandwich configuration having first and second identical conductor configurations positioned on opposite sides of a central tunable dielectric layer and whose reactance varies as a function of an applied voltage, wherein said first and second conductor configurations are spiral configurations.

8. The antenna element according to claim 7, wherein said first and second conductor configurations are planar spiral configurations.

9. The antenna element according to claim 7, wherein said first and second conductor configurations are logarithmic spiral configurations.

10. The antenna element according to claim 7, wherein said central tunable dielectric layer is a layer of Barium titanate (BaTiO3).

11. The antenna element according to claim 7, wherein said central tunable dielectric layer is a layer of Strontium titanate ($SrTiO_3$).

12. The antenna element according to claim 7, wherein said applied voltage is a DC field.

13. The antenna element according to claim 12, wherein said applied voltage varies the effective electrical length of said antenna element according to the magnitude of said applied voltage.

14. The antenna element according to claim 13, wherein said applied voltage varies the impedance of said antenna element.

15. The antenna element according to claim 12, wherein said applied voltage improves the low frequency response of said antenna element.

* * * * *